United States Patent [19]

Wilsberg

[11] Patent Number: 4,623,471

[45] Date of Patent: Nov. 18, 1986

[54] AQUEOUS TEXTILE WASHING COMPOSITIONS

[75] Inventor: Heinz-Manfred Wilsberg, Cologne, Fed. Rep. of Germany

[73] Assignee: Henkel Kommanditgesellschaft auf Aktien, Duesseldorf, Fed. Rep. of Germany

[21] Appl. No.: 716,271

[22] Filed: Mar. 26, 1985

[30] Foreign Application Priority Data

Mar. 31, 1984 [DE] Fed. Rep. of Germany ..... 3412090

[51] Int. Cl.[4] ..... C11D 1/835; C11D 3/32

[52] U.S. Cl. ..... 252/8.8; 252/542; 252/544; 252/547; 252/548; 252/DIG. 14

[58] Field of Search ..... 252/8.8, 153, 542, 547, 252/548, DIG. 14, 544

[56] References Cited

U.S. PATENT DOCUMENTS

| | | | |
|---|---|---|---|
| 3,704,228 | 11/1972 | Eckert et al. | 252/117 |
| 3,775,316 | 11/1973 | Berg et al. | 252/8.8 |
| 4,129,506 | 12/1978 | Wallhäusser et al. | 252/8.8 |
| 4,140,641 | 2/1979 | Ramachandran | 252/8.75 |
| 4,214,997 | 7/1980 | Morris et al. | 252/8.8 |
| 4,268,401 | 5/1981 | Meschkat et al. | 252/8.8 |
| 4,348,305 | 9/1982 | Hennemann et al. | 252/542 |
| 4,446,042 | 5/1984 | Leslie | 252/102 |
| 4,526,694 | 7/1985 | Puchta et al. | 252/8.8 |

FOREIGN PATENT DOCUMENTS

| | | |
|---|---|---|
| 13780 | 8/1980 | European Pat. Off. . |
| 18630 | 11/1980 | European Pat. Off. . |
| 2426581 | 12/1974 | Fed. Rep. of Germany . |
| 2342364 | 10/1977 | Fed. Rep. of Germany . |
| 2817834 | 5/1983 | Fed. Rep. of Germany . |

*Primary Examiner*—Prince E. Willis

*Attorney, Agent, or Firm*—Ernest G. Szoke; Henry E. Millson, Jr.; Mark A. Greenfield

[57] ABSTRACT

A condensate of fatty acid and hydroxyalkyl polyamine is used as an opacifier and thickener in liquid washing preparations free from anionic surfactants and containing fabric-softening quaternary ammonium compounds and at least 10% by weight of nonionic surfactants. The use of this condensate provides for excellent viscosity/-temperature behavior during the storage and handling of the liquid washing preparations over a wide temperature range.

11 Claims, No Drawings

AQUEOUS TEXTILE WASHING COMPOSITIONS

BACKGROUND OF THE INVENTION

1. Field of the Invention

This invention relates to condensates of fatty acids and hydroxyalkyl polyamines and their use as opacifiers and thickeners in surfactant-containing compositions such as liquid washing preparations.

2. Description of Related Art

Liquid surfactant-containing compositions are used, for example, for washing fabrics or as shampoos for washing hair. In many cases, these compositions contain active ingredients which impart antistatic properties and body, respectively, to the fabrics and hair washed with them. The most common active ingredients are quaternary ammonia- or imidazoline-based cationic compounds containing 2 long-chain $C_{10}$–$C_{24}$ groups in the molecule. In combination with anionic surfactants, however, the cationic active ingredients can only be used with considerable limitations because the cationic compounds weaken the effect of the anionic surfactants and vice-versa. For this reason, the surfactants present in such compositions are generally nonionic surfactants which, in many cases, are specially selected to obtain an optimal combination of properties. German Application No. 2 817 834 for example relates to liquid compositions containing special combinations of specially selected nonionic surfactants and cationic active ingredients. Attempts to produce compositions having a high content both of surfactants and of cationic active substances are attended by problems attributable to a marked increase in viscosity with increasing concentration of the ingredients. Concentrates of the type in question lose their fluidity at temperatures of the order of +5° C. On the other hand, they lose their stability and tend to separate in the event of prolonged storage at temperatures of the order of +40° C. These difficulties can be avoided or reduced by using, instead of the outstandingly effective quaternary ammonium compounds containing 2 long alkyl residues, those containing 2 long $C_{10}$–$C_{24}$ alkenyl residues which show better solubility and dispersibility in the aqueous system than the compounds containing 2 long alkyl residues. Particularly soluble compounds containing 2 long alkenyl residues are derived from imidazoline. One typical representative is 1-methyl-1-oleylamidoethyl-2-oleylimidazolinium methosulfate commercially available as REWOQUAT W 3690, a trademarked product of REWO Chemische Werke GmbH, Steinau, Federal Republic of Germany. With compounds of this type, it is possible to prepare liquid compositions which contain up to 70% by weight of nonionic surfactants and, depending on their surfactant content, up to 35% by weight of a quaternary ammonium compound. Up to one quarter of the quantity of the quaternary ammonium compound may be replaced by compounds derived from ammonia, for example by ditallow alkyl dimethylammonium salts.

Although the compositions described above show good flow properties at low temperatures and high stability in storage at elevated temperature, they lack "consistency" which, to the consumer, is a sign of a high concentration of active ingredients. In the context of the invention, "consistency" is understood to be a viscosity of the compositions of from 300 to 1500 mPa.s at +5° to +40° C. combined with opacity.

U.S. Pat. No. 3,775,316 relates to a softening finishing composition for washed laundry; and the relevancy of this patent to the present invention is described below in the description of the invention.

DESCRIPTION OF THE INVENTION

Other than in the operating examples, or where otherwise indicated, all numbers expressing quantities of ingredients or reaction conditions used herein are to be understood as modified in all instances by the term "about."

An object of the present invention is to impart consistency to liquid, storable compositions free from anionic surfactants and containing fabric-softening imidazolinium compounds and at least 10% by weight of nonionic surfactants. According to the invention, this object is achieved by using fatty acid/hydroxyalkyl polyamine condensates as opacifiers and thickeners in the above compositions.

In the context of the invention, fatty acid/hydroxyalkyl polyamine condensates (hereinafter referred to as fatty acid condensates) are understood to be reaction products of higher fatty acids ($C_8$–$C_{24}$) or derivatives thereof with hydroxyalkyl polyamines. These fatty acid condensates are described in detail in U.S. Pat. No. 3,775,316, the disclosure of which is expressly incorporated herein by reference. The fatty acid condensates are used in U.S. Pat. No. 3,775,316 in combination with quaternary ammonium compounds as fabric softeners in a liquid fabric conditioner which may contain standard additives, such as for example nonionic dispersion and emulsification aids and acidifiers in small quantities.

The fatty acid condensates used in the practice of the present invention and which are more fully described in U.S. Pat. No. 3,775,316 are fatty acid hydroxyalkylpolyamine condensation products of one mol of a hydroxyalkyl-alkylpolyamine having at least one hydroxyalkyl selected from hydroxyethyl, hydroxypropyl and dihydroxypropyl and at least two hydrogen atoms bonded to nitrogen atoms, preferably of the formula

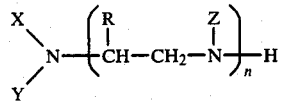

wherein X is a member selected from the group consisting of hydroxyethyl, hydroxypropyl and dihydroxypropyl, Y and Z are selected from the group consisting of hydrogen, and X, with the proviso that one hydroxyalkyl selected from the group consisting of hydroxyethyl, hydroxypropyl and dihydroxypropyl and at least two hydrogen atoms bonded to nitrogen atoms, with 1 to 4 mols of a mixture of fatty acids having from 8 to 24 carbon atoms, at least half of said fatty acids in said mixture having more than 15 carbon atoms.

The fatty-acid condensates are preferably derived from the hydroxyalkyl derivatives of ethylene diamine or of diethylene triamine, such as, hydroxyethylethylene diamine, dihydroxyethylethylene diamine, hydroxyethyldiethylene triamine, hydroxypropyldiethylene triamine, etc. Of particular practical interest are the derivatives of N-hydroxyethylethylene diamine. A particularly preferred product is produced by reacting 1 mole of hardened beef tallow with 1 mole of hydroxyethyl ethylene diamine.

Such fatty acid condensates are obtained by the reaction of 1 to 4, preferably 1.5 to 3 mols of fatty acid radicals which can be utilized in the form of the free fatty acids, of the lower alkylesters, of the acid halides, or of the glycerides, particularly of the triglycerides, with one mol of the hydroxyalkylpolyamine where, however, not more fatty acid is present as can be bound by the amine nitrogen as an amide and/or to the hydroxyl groups as an ester. For instance, in the case of N-hydroxyethylethylene diamine, 2 to 3 mols of fatty acid radicals are reacted.

When lower alkyl esters of the fatty acids are employed, they are preferably those having 1 to 4 carbon atoms in the alkyl, such as, methyl, ethyl, propyl or butyl esters. When a fatty acid halide is used, preferably the chloride is used. When glycerides are employed, particularly triglycerides of the higher fatty acids, with 8 to 24, preferably 16 to 22, carbon atoms in the fatty acid radical are used. Insofar as the glycerides contain fatty acid radicals with 8 to 14 carbon atoms, the amount of fatty acid radicals with 16 to 22 carbon atoms in the mixed glycerides or mixtures of glycerides shall be at least 50%. The fatty acid radicals can be derived from the caprylic, pelargonic, capric, undecylic, lauric, myristic, palmitic, stearic, oleic, arachic or behenic acids for example. Preferably, however, natural fats are utilized. The fats of plants, land and sea animals, for example, coconut fat, palm oil, olive oil, linseed oil, cottonseed oil, soybean oil, peanut oil, rape seed oil, lard, tallow and particularly the completely or partly hardened products of these fats as well as hardened fish or whale oil are of interest as natural fats.

Methods for the preparation of the above fatty acid condensates are described in detail in U.S. Pat. No. 3,775,316.

Depending on the type and quantity of the other ingredients of the compositions of the invention, an addition of from 0.4 to 5% by weight of the fatty acid condensate is used for imparting consistency. Like the imidazolinium compounds described below which are present in the compositions of the invention, the fatty acid condensates contribute toward the antistatic finishing and softening or conditioning effect of the compositions of the invention which preferably consist of (a) from 10 to 70% by weight of at least one nonionic surfactant,
(b) from 1 to 35% by weight of at least one imidazolinium compound,
(c) from 0.4 to 5% by weight of at least one fatty acid condensate,
(d) from 1 to 20% by weight of at least one organic solvent, preferably a monohydric or polyhydric alcohol, and balance to 100% by weight water, and, optionally, small quantities of perfumes, dyes, preservatives, microbicides lustering agents, enzymes, foam regulators, and other additives commonly used in liquid washing preparations.

Suitable nonionic surfactants are, preferably, adducts of ethylene oxide and/or propylene oxide with fatty alcohols and/or with oxoalcohols and, in particular, mixtures of fatty alcohol ethoxylates with oxoalcohol ethoxylates. Compositions which are particularly effective in terms of cleaning and foaming power contain fatty alcohol ethoxylates and oxoalcohol ethoxylates containing from 10 to 18 and preferably from 10 to 15 carbon atoms in the parent alcohol and, in either case, from 50 to 70% by weight of ethylene oxide in the molecule, particularly fatty alcohol ethoxylates to oxoalcohol ethoxylates in a ratio by weight of from 3:1 to 1:3.

The imidazolinium compounds used in the compositions of the invention contain 2 long chain ($C_{10}$–$C_{24}$) alkyl or alkenyl groups, preferably alkenyl groups. A preferred compound for use herein is 1-methyl-1-oleylamidoethyl-2-oleylimidazolinium methosulfate commercially available as REWOQUAT W 3690, a trademarked product of REWO Chemische Werke GmbH, Steinau, Federal Republic of Germany. Up to one quarter of the quantity of the imidazolinium compound may be replaced by compounds derived from ammonia, for example by ditallow alkyl dimethylammonium salts.

The organic solvent is preferably a monohydric or polyhydric low molecular weight alcohol (for example ethanol, isopropyl alcohol, 1,2-propylene glycol, or glycerine).

The preservative generally used for the liquid compositions of the invention is formalin in a quantity of from 0.05 to 1% by weight. Lustering agents give the compositions, for example, a nacreous luster. A typical agent producing a nacreous luster is a commercial mixture of ethylene glycol mono- and distearic acid esters which develops a particularly good effect in the compositions of the invention. The lustering agent is best used in the form of a premix with nonionic surfactants, preferably with part of the nonionic surfactants (a) of the compositions in a ratio by weight of from 3:1 to 1:3 and, optionally, with water. The lustering agent, the surfactants and, optionally, the water are mixed at a temperature above the melting temperature of the lustering agent, after which the mixture is cooled to a temperature below the melting temperature of the lustering agent and the premix mixed with the rest of the surfactant, the quaternary ammonium compound, the solvents and, optionally, the other constituents of the composition at a temperature below the melting temperature of the lustering agent.

Particularly favorable properties are shown by compositions in which the fatty acid condensate is used in compositions which contain (a) from 15 to 40% by weight of at least one nonionic surfactant,
(b) from 5 to 15% by weight of at least one imidazolinium compound,
(c) from 0.5 to 3% by weight of at least one fatty acid condensate,
(d) from 5 to 15% by weight of at least one mono- or polyhydric alcohol containing from 2 to 4 carbon atoms,
(e) from 0.2 to 3.0% by weight of a lustering agent, balance to 100% by weight of water, with optionally, small quantities of perfumes, dyes, and preservatives.

Preferred compositions are those containing (a) from 15 to 40% by weight of a 1:1 mixture of the reaction products of a $C_{14}$–$C_{15}$ oxoalcohol and 7 moles of ethylene oxide and the reaction product of a $C_{10}$–$C_{12}$ fatty alcohol and 6 moles of ethylene oxide,
(b) from 5 to 15% by weight of 1-methyl-1-oleylamidoethyl-2-oleyl imidazolinium methosulfate,
(c) from 0.5 to 3% by weight of a fatty acid condensate,
(d) from 4 to 9% by weight of 1,2-propylene glycol and from 1 to 6% by weight of ethanol,
(e) from 0.2 to 3.0% by weight of a mixture of ethylene glycol mono- and distearic acid esters, balance to 100% by weight water and, optionally, in small quantities, perfumes, dyes, and preservatives.

The compositions, of the invention are free-flowing and stable in storage for long periods at temperatures in the range of from +5° to +40° C. They do not gel on contact with water and can be used with advantage for washing and, at the same time, softening fabrics of wool or cotton, synthetic fibers, such as polyester, polyacrylonitrile, polyamide and mixtures of wool or cotton and synthetic fibers. The washing and softening process can be carried out either in a washing machine or by hand at washing temperatures of up to about 60° C. The in-use concentration of the preparations of the invention is generally from 1 to 20 ml/l of wash liquor and preferably from 2 to 15 ml/l. The compositions are distinguished by the fact that they clean the fabrics satisfactorily and, at the same time, leave them with a pleasant feel and with antielectrostatic properties. Where washing is carried out by hand in a wash basin, they form a dense, pleasant lather; where washing is carried out in a washing machine, no overfoaming is observed. In addition, the foam can readily be washed away.

The invention is illustrated, but not limited, by the following examples.

EXAMPLES

The following Examples describe the consistency-imparting effect of a fatty acid condensate of the invention in liquid washing preparations based on nonionic surfactants and quaternary imidazolinium compounds containing 2 long-chain alkenyl residues. The fatty acid condensate was obtained by reacting 1 mole of hardened beef tallow with 1 mole of hydroxyethyl ethylene diamine at 90° to 100° C. in accordance with the process set forth in U.S. Pat. No. 3,775,316. Examples 1 to 4 are Comparison Examples for state-of-the-art washing preparations without a fatty acid condensate. Examples 5 to 8 are Examples illustrating the present invention. The consistency data apply to washing preparations which had been stored for 1 week because viscosity can change slightly in the first few days after preparation of the washing mixtures. Where possible, viscosity was determined at 20° C. using a Brookfield RVT rotational viscosimeter (spindle 2, 20 r.p.m.). All the washing preparations contained 0.1% by weight of 30% formalin as a preservative. The balance to 100% by weight of the formulations in Table 1 is water. All the concentrations in Table 1 are expressed in % by weight.

TABLE 1

| | 1 | 2 | 3 | 4 | 5 | 6 | 7 | 8 |
|---|---|---|---|---|---|---|---|---|
| $C_{14}$–$C_{15}$ oxoalcohol ethoxylate with 7 moles ethylene oxide[1] | 14.25 | 14.1 | 14.25 | 14.25 | 14.1 | 14.25 | 9.5 | 19.0 |
| $C_{10}$–$C_{12}$ fatty alcohol ethoxylate with 6 moles ethylene oxide[2] | 14.25 | 14.1 | 14.25 | 14.25 | 14.1 | 14.25 | 9.5 | 19.0 |
| Fatty acid condensate | — | — | — | — | 1.0 | 1.0 | 1.0 | 1.0 |
| Dimethyl distearyl ammonium chloride[3] | 4.0 | — | — | — | — | — | — | |
| 1-methyl-1-oleylamidoethyl-2-oleylimidazolinium methosulfate[4] | — | 7.0[6] | 8.0 | 6.0 | 7.0 | 7.0 | 4.0 | 8.0 |
| Ethylene glycol mono-/di-stearate mixture[3] | — | 0.42 | — | — | 0.42 | — | — | — |
| 1,2-propylene glycol | 7.5 | 6.0 | 5.0 | 6.0 | 6.0 | 6.0 | 6.0 | 6.0 |
| Ethanol | 7.5 | 3.0 | 5.0 | 3.0 | 3.0 | 3.0 | 3.0 | 3.0 |
| Perfume | 0.6 | — | — | 1.0 | 1.0 | — | 1.0 | 1.0 |
| Dye | — | 0.035 | — | 0.035 | 0.00034 | — | 0.035 | 0.035 |
| Viscosity mPa · s | 220 | 2200 | 205 | 160 | 600 | 540 | 576 | 456 |
| Appearance | slightly opaque | opaque nacreous | clear | clear | opaque nacreous | opaque | opaque | opaque |

[1]Dobanol 45-7, trademark of Shell;
[2]Marlipal KF, trademark of Chem. Werke Huls;
[3]Prapagen WK, trademark of Hoechst;
[4]Rewoquat 3690, trademark of Rewo;
[5]Cutina AGS, trademark of Henkel;
[6]The two long residues of this imidazolinium compound are stearyl residues.

All of the washing preparations of the invention (Examples 5 to 8) were still free-flowing at +5° C.; they were stable in storage at +40° C. They are all opaque or opaque with a nacreous luster. By contrast, the preparations without the fatty acid condensate (Examples 1 to 4) were clear and/or did not flow freely at +5° C. and/or were unstable at +40° C. In addition to a good detergent effect at washing temperatures as low as 40° C., the fabrics of different fibers washed with them had a distinctly softer and fuller feel than comparision preparations having otherwise the same composition without the softening component. Virtually all the foam formed during washing was washed out surprisingly easily.

What is claimed is:

1. An aqueous textile washing composition free from anionic surfactants comprising (a) from about 10 to about 70% by weight of at least one nonionic surfactant which is an adduct of ethylene oxide and/or propylene oxide with fatty alcohols and/or with oxoalcohols;

(b) from about 1 to about 35% by weight of at least one imidazolinium compound which contains 2 long chain ($C_{10}$–$C_{24}$) alkyl or alkenyl groups;

(c) from about 0.4 to about 5% by weight of a fatty acid-hydroxyalkyl polyamine condensate which is obtained by the reaction of 1 to 4 mols of fatty acid radicals obtained from either free fatty acids, from their lower alkyl esters, from their acid halides, or from their glycerides, with one mole of hydroxylaklylpolyamine;

(d) from about 1 to about 20% by weight of at least one monohydric or polyhydric alcohol.

2. An aqueous composition in accordance with claim 1 wherein the composition also contains one or more of the following: a lustering agent, a perfume, a dye, a preservative, a microbicide, an enzyme, and a foam regulator.

3. An aqueous composition in accordance with claim 1 wherein the imidazolinium compound in (b) contains two $C_{10}$–$C_{24}$ alkyl or alkenyl groups.

4. An aqueous composition in accordance with claim 3 wherein the two $C_{10}$–$C_{24}$ groups are both oleyl groups.

5. An aqueous composition in accordance with claim 1 wherein the nonionic surfactant in (a) is an adduct of ethylene oxide and/or propylene oxide with a fatty alcohol and/or an oxoalcohol.

6. An aqueous composition in accordance with claim 1 wherein the nonionic surfactant in (a) is a mixture of fatty alcohol ethoxylates and oxoalcohol ethoxylates.

7. An aqueous composition in accordance with claim 2 wherein the lustering agent is a mixture of ethylene glycol mono- and di-stearic acid esters.

8. An aqueous composition in accordance with claim 1 wherein the ingredients are present in the following quantities:

component (a) from about 15 to about 40% by weight;

component (b) from about 5 to about 15% by weight;

component (c) from about 0.5 to about 3% by weight;

component (d) from about 5 to about 15% by weight.

9. An aqueous composition in accordance with claim 8 wherein from about 0.2 to about 3.0% by weight of a lustering agent is present therein.

10. An aqueous composition in accordance with claim 8 wherein component (d) is a monohydric or polyhydric alcohol having from 2 to 4 carbon atoms, or a mixture of such alcohols.

11. An aqueous composition in accordance with claim 1 wherein the composition comprises:

(a) from about 15 to about 40% by weight of an approximately 1:1 mixture of the reaction product of a $C_{14}$–$C_{15}$ oxoalcohol with 7 moles of ethylene oxide and the reaction product of a $C_{10}$–$C_{12}$ fatty alcohol with 6 moles of ethylene oxide;

(b) from about 5 to about 15% by weight of 1-methyl-1-oleylamidoethyl-2-oleyl imidazolinium methosulfate:

(c) from about 0.5 to about 3% by weight of a fatty acid hydroxyalkyl polyamine condensate:

(d) from about 4 to about 9% by weight of 1,2-propylene glycol and from about 1 to about 6% by weight of ethanol; and (e) from about 0.2 to about 3.0% by weight of a mixture of ethylene glycol mono-distearic acid esters.

* * * * *